US007719508B2

(12) United States Patent
Eom

(10) Patent No.: US 7,719,508 B2
(45) Date of Patent: May 18, 2010

(54) SCAN DRIVING APPARATUS, FLAT PANEL DISPLAY HAVING THE SAME, AND DRIVING METHOD THEREOF

(75) Inventor: Ki Myeong Eom, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1391 days.

(21) Appl. No.: 11/138,665

(22) Filed: May 27, 2005

(65) Prior Publication Data

US 2005/0268192 A1 Dec. 1, 2005

(30) Foreign Application Priority Data

May 28, 2004 (KR) ..... 10-2004-0038364

(51) Int. Cl.
*G09G 3/36* (2006.01)

(52) U.S. Cl. ..... 345/99; 345/87; 345/204

(58) Field of Classification Search ..... 345/87–100, 345/204, 690–694
See application file for complete search history.

(56) References Cited

U.S. PATENT DOCUMENTS

| | | | | |
|---|---|---|---|---|
| 4,675,754 | A * | 6/1987 | Endo et al. | 360/32 |
| 5,056,120 | A * | 10/1991 | Taniguchi et al. | 375/371 |
| 5,550,653 | A * | 8/1996 | TeWinkle et al. | 358/514 |
| 6,310,921 | B1 * | 10/2001 | Yoshioka et al. | 375/240.26 |
| 6,784,898 | B2 * | 8/2004 | Lee et al. | 345/692 |
| 7,027,018 | B2 * | 4/2006 | Nitta et al. | 345/87 |
| 7,184,323 | B2 * | 2/2007 | Fujisawa | 365/189.05 |
| 7,317,461 | B2 * | 1/2008 | Uchida et al. | 345/690 |

FOREIGN PATENT DOCUMENTS

| | | |
|---|---|---|
| JP | 11-296129 | 10/1999 |
| JP | 2000-227784 | 8/2000 |
| JP | 2002-215105 | 7/2002 |

* cited by examiner

*Primary Examiner*—Nitin Patel
(74) *Attorney, Agent, or Firm*—H.C. Park & Associates, PLC

(57) ABSTRACT

A scan driving apparatus having decreased size and power consumption, a flat panel display having the same, and a driving method thereof. The scan driving apparatus comprises a shift register generating output signals shifted in sequence in response to a clock signal, and a scan signal generator generating at least four scan signals in a cycle of the clock signal based on the output signals from the shift register and at least two control signals.

23 Claims, 4 Drawing Sheets

SCAN DRIVING APPARATUS, FLAT PANEL DISPLAY HAVING THE SAME, AND DRIVING METHOD THEREOF

CROSS-REFERENCE TO RELATED APPLICATIONS

This application claims priority to and the benefit of Korean Patent Application No. 10-2004-0038364, filed May 28, 2004, which is hereby incorporated by reference for all purposes as if fully set forth herein.

BACKGROUND OF THE INVENTION

1. Field of the Invention

The present invention relates to a flat panel display, and more particularly, to a flat panel display scan driving apparatus with decreased size and power consumption.

2. Discussion of the Background

Various flat panel displays have been recently developed as alternatives to heavier and bulkier cathode ray tubes (CRT). Such displays include liquid crystal displays (LCD), field emission displays (FED), plasma display panels (PDP), and electroluminescent displays.

A conventional flat panel display may comprise a display region having a plurality of pixels formed at scan line and data line crossings, a scan driver to drive the scan lines, a data driver to drive the data lines, and a controller, which controls the scan driver and the data driver and transmits a data signal to the data driver.

Transmitting a scan signal to the scan line selects a pixel, and the pixel displays an image corresponding to the data signal transmitted to the data line. The pixel may be a liquid crystal cell of an LCD, a discharge cell of the FED or the PDP, or a light-emitting cell of the electroluminescent display.

The controller transmits a selection control signal to the scan driver to control its timing, transmits a data control signal to the data driver to control the data driver's timing, and transmits the external data signal to the data driver.

The scan driver may output the scan signals for sequentially driving the scan lines in response to the selection control signals, which may include a start pulse, a clock signal, and a control signal transmitted from the controller. Such a scan driver may comprise a plurality of registers to output the scan signals.

The data driver transmits the data signal from the controller to the pixel through the data lines in response to the controller's data control signals. The data driver may output the data signal to the data line corresponding to one horizontal line 1H every one horizontal period.

As FIG. 1 shows, in the conventional flat panel display, the data signal may be transmitted to the data line corresponding to one horizontal line 1H based on the data driver's clock signal every one cycle T of the clock signal CLK transmitted to the scan driver.

Thus, the conventional flat panel display may consume a lot of power because of a scan driver register's operating frequency. Also, N registers may be needed to transmit the scan signal to N scan lines. In other words, the number of registers increases proportionally to the number of scan lines, thereby increasing the scan driver's size.

SUMMARY OF THE INVENTION

The present invention provides a smaller scan driving apparatus that may consume less power, a flat panel display having the same, and a driving method thereof.

Additional features of the invention will be set forth in the description which follows, and in part will be apparent from the description, or may be learned by practice of the invention.

The present invention discloses a scan driving apparatus comprising a shift register generating output signals shifted in sequence in response to a clock signal and a scan signal generator. The scan signal generator generates at least four scan signals in a cycle of a clock signal based on the output signals from the shift register and at least a first control signal and a second control signal.

The present invention also discloses a flat panel display comprising an image display part having a plurality of pixels defined by n scan lines and m data lines, a scan driver outputting at least four scan signals in sequence to the scan lines in a cycle of a clock signal, and a data driver transmitting a data signal to the data lines.

The present invention also discloses a method of driving a flat panel display comprising an image display part having a plurality of pixels defined by n scan lines and m data lines. The method comprises transmitting at least four scan signals in sequence to the scan lines in a cycle of a clock signal, and transmitting a data signal synchronized with the scan signals to the data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF ILLUSTRATED EMBODIMENTS

Hereinafter, exemplary embodiments of the present invention will be described in detail with reference to FIG. 2, FIG. 3, FIG. 4 and FIG. 5.

Figure 1:
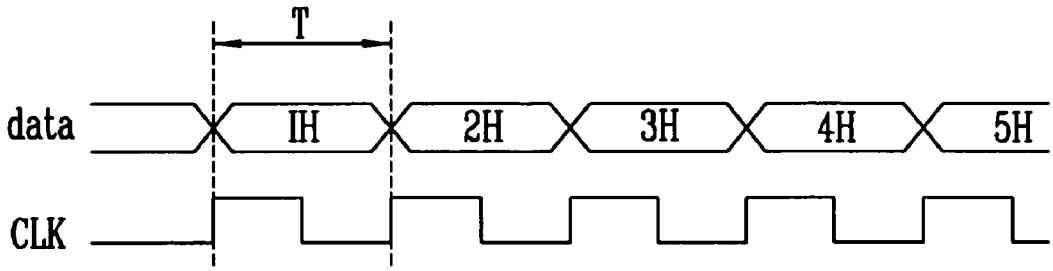
FIG.1 PRIOR ART
FIG. 1 shows waveforms of a data signal and a clock signal of a conventional scan driver.
Figure 2:
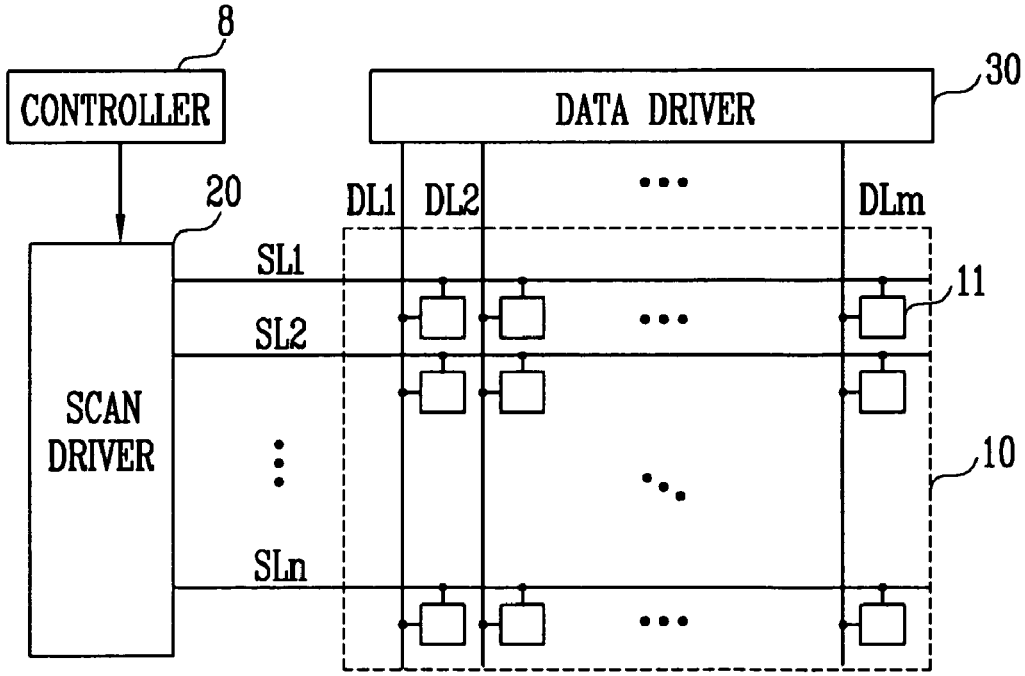
FIG. 2 is a schematic view showing a flat panel display according to an exemplary embodiment of the present invention.

FIG. 2 is a schematic view of a flat panel display comprising a scan driver according to an exemplary embodiment of the present invention.

Referring to FIG. 2, the flat panel display may comprise an image display portion 10 including a plurality of pixels 11 at intersections of a plurality of scan lines SL1~SLn and a plurality of data lines DL1~DLm, a scan driver 20 sequentially transmitting at least four scan signals SS every clock signal cycle, a data driver 30 to drive the data lines, and a controller 8 controlling the scan driver 20 and the data driver 30.

A pixel 11 may be selected by the scan signal SS transmitted to the scan line SL, and the pixel displays an image corresponding to the data signal transmitted to the corresponding data line DL. The scan driver 20 may be used to select a liquid crystal cell of an LCD, a discharge cell of an FED or a PDP, or a light-emitting cell of an electroluminescent display.

The controller 8 transmits a selection control signal to the scan driver 20 to control the driver's timing, transmits a data control signal to the data driver 30 to control the data driver's timing, and transmits a data signal to the data driver 30.

Figure 3:
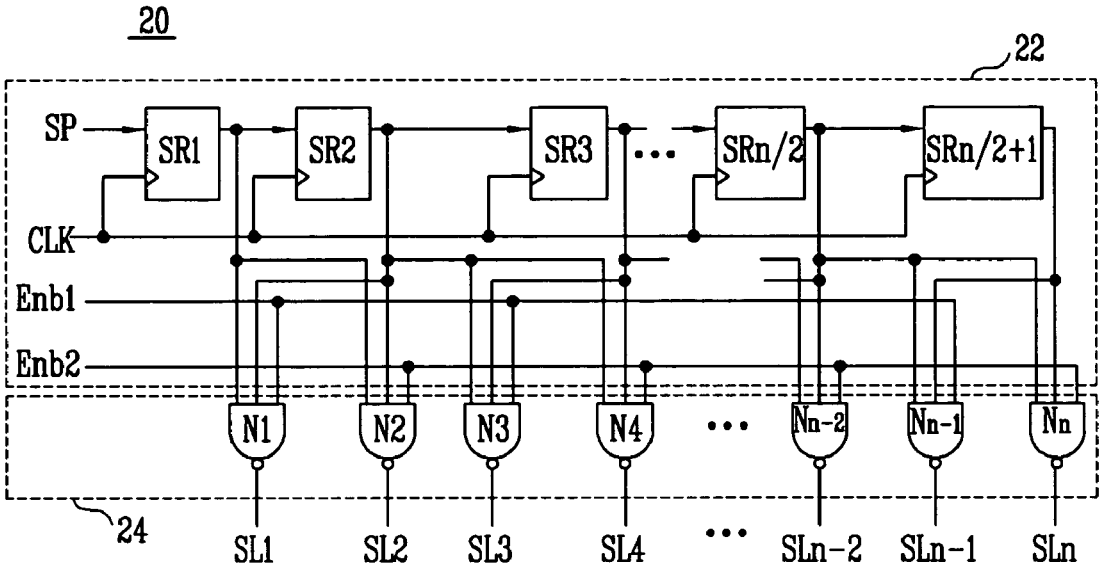
FIG. 3 is a view showing the scan driver according to an exemplary embodiment of the present invention.

FIG. 3 shows the scan driver according to an exemplary embodiment of the present invention.

Referring to FIG. 3, the scan driver 20 may generate scan signals SS in response to the controller's selection control signals, which may include a start pulse SP, a clock signal CLK, and two control signals Enb1, Enb2, and sequentially transmit the scan signals SS to the scan lines SL.

The scan driver 20 may comprise a shift register 22, which may include a plurality of registers SR, and a scan signal generator 24, which may comprise a plurality of NAND gates N.

The shift register 22 may comprise (n/2)+1 registers SR1~SRn/2+1 to transmit the scan signals SS to n scan lines SL1~SLn. A register may shift the start pulse SP from the controller 8 in accordance with the clock signals CLK in sequence and transmit the shifted start pulse SP to the scan signal generator 24.

More specifically, the $1^{st}$ register SR1 transmits output signals to the $1^{st}$ and $2^{nd}$ NAND gates N1, N2. The $(n/2+1)^{th}$ register SRn/2+1 transmits output signals to the $n-1^{th}$ and $n^{th}$ NAND gates Nn−1, Nn. Also, a register SRj (where, j=2, 3, 4, . . . , n/2), among the $2^{nd}$~$(n/2)^{th}$ registers SR2~SRn/2, transmits an output signal to four NAND gates Nk−3, Nk−2, Nk−1, Nk (where k=2×j). Accordingly, two adjacent registers SR among the $2^{nd}$~$(n/2)^{th}$ registers SR2~SRn/2 transmit the output signals to two adjacent NAND gates N.

For example, the $2^{nd}$ register SR2 transmits output signals to the $1^{st}$~$4^{th}$ NAND gates N1, N2, N3, N4, respectively. Further, the $3^{rd}$ register SR3 transmits output signals to the $3^{rd}$~$6^{th}$ NAND gates N3, N4, N5, N6, respectively. Likewise, each of the $4^{th}$~$(n/2)^{th}$ registers SR4~SRn/2 transmits output signals to four NAND gates Nk−3, Nk−2, Nk−1, Nk (where k=2×j), respectively.

Each NAND gate N1~Nn receives the output signals from the $i^{th}$ register SRi and the $(i+1)^{th}$ register SRi+1 (where i is a positive integer of 1 or more), respectively, and receives the first or second control signal Enb1, Enb2, which may have the same cycle and be transmitted leaving a predetermined time difference. The first control signal Enb1 may be transmitted to odd NAND gates N1, N3, . . . Nn-1, and the second control signal Enb2 may be transmitted to even NAND gates N2, N4, . . . Nn. Here, each cycle of the first and second control signals Enb1, Enb2 may be half that that of the clock signal CLK transmitted to the shift register 22. According to an exemplary embodiment of the present invention, the cycle of the clock signal CLK transmitted to the shift register 22 may be four times longer than that of the conventional clock signal CLK.

Figure 4:
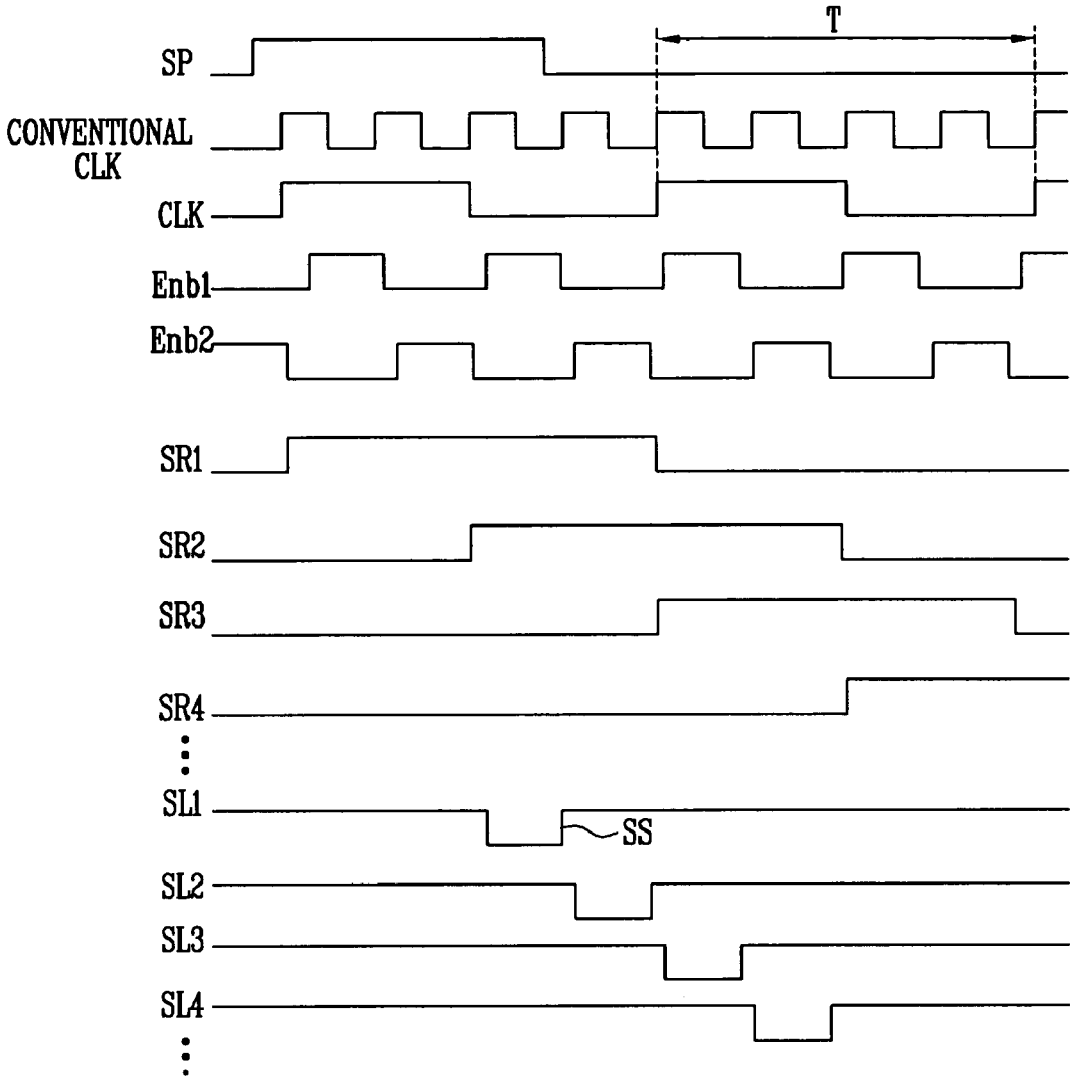
FIG. 4 shows driving signal and output signal waveforms of the scan driver according to an exemplary embodiment of the present invention.

FIG. 4 shows waveforms of driving signals and output signals in the scan driver according to an exemplary embodiment of the present invention.

Referring to FIG. 3 and FIG. 4, the NAND gates N1~Nn operate as follows.

The odd NAND gates N1, N3, . . . , Nn−1 apply the NAND operation to the first control signal Enb1 and the output signals transmitted from the $i^{th}$ register SRi and the $(i+1)^{th}$ register SRi+1, thereby generating the scan signal SS for the odd scan lines. Further, the even NAND gates N2, N4, . . . , Nn apply the NAND operation to the second control signal Enb2 and the output signals transmitted from the $i^{th}$ register SRi and the $(i+1)^{th}$ register SRi+1, thereby generating the scan signal SS for the even scan lines.

For example, in the case of the $1^{st}$~$4^{th}$ NAND gates N1~N4, the $1^{st}$ NAND gate N1 applies the NAND operation to the output signal from the $1^{st}$ register SR1, the output signal from the $2^{nd}$ register SR2, and the first control signal Enb1, thereby outputting the scan signal SS to the first scan line SL 1. The $2^{nd}$ NAND gate N2 applies the NAND operation to the output signal from the $1^{st}$ register SR1, the output signal from the $2^{nd}$ register SR2, and the second control signal Enb2, thereby outputting the scan signal SS to the second scan line SL2. The $3^{rd}$ NAND gate N3 applies the NAND operation to the output signal from the $2^{nd}$ register SR2, the output signal from the $3^{rd}$ register SR3, and the first control signal Enb1, thereby outputting the scan signal SS to the third scan line SL3. The $4^{th}$ NAND gate N4 applies the NAND operation to the output signal from the $2^{nd}$ register SR2, the output signal from the $3^{rd}$ register SR3, and the second control signal Enb2, thereby outputting the scan signal SS to the fourth scan line SL4.

Thus, in the scan driver 20, as shown in FIG. 4, n/2+1 registers SR1~SRn/2+1 sequentially output the start pulses SP according to the clock signals CLK, and n NAND gates N1~Nn apply the NAND operation to the output signals from the registers according to the first and second control signals Enb1, Enb2, thereby sequentially outputting the scan signals SS to the scan lines. The scan driver 20 may sequentially output four scan signals SS to four scan lines, respectively, for every cycle of the clock signal CLK.

The data driver 30 may transmit the data signal from the controller 8 to the pixel 11 through the data line DL in response to the controller's data control signals. The data driver 30 may transmit the data signal corresponding to one horizontal line every one horizontal period for which the scan driver 20 transmits the scan signal SS to the scan line SL.

Figure 5:
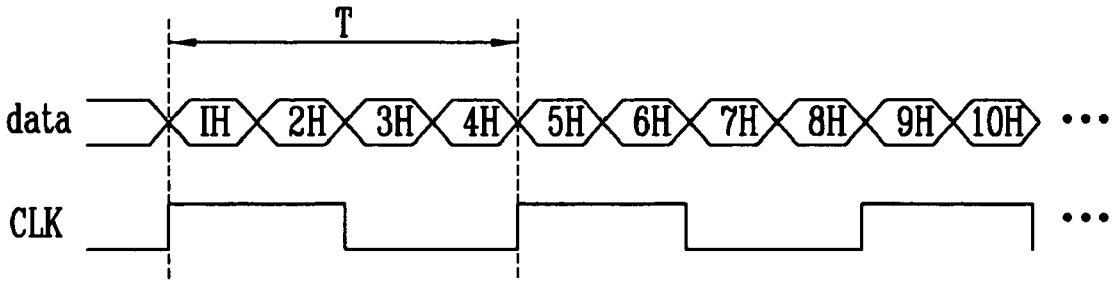
FIG. 5 shows waveforms of a data signal transmitted and a clock signal according to an exemplary embodiment of the present invention.

FIG. 5 shows waveforms of a data signal and a clock signal transmitted to the scan driver of the flat panel display according to an exemplary embodiment of the present invention.

Referring to FIG. 2 and FIG. 5, the data driver 30 may transmit the data signals corresponding to four horizontal lines 1H, 2H, 3H, 4H to the data line DL every cycle T of the clock signal CLK transmitted to the scan driver 20.

Thus, the operation frequency of the register SR may be decreased by half. Since the operation frequency of the register SR may decrease, the switching time of the register SR decreases, thereby reducing the scan driver's power consumption. Further, in the flat panel display according to an exemplary embodiment of the present invention, third through $j^{th}$ control signals Enb3 through Enbj (where j is a positive integer of 3 or more), together with the first and second control signals Enb1, Enb2, may be transmitted to the scan signal generator 24 in consideration of gate-on time, provided the gate-on time does not affect the image displayed on the image display portion 10. Thus, the scan driver 20 may sequentially generate at least four scan signals SS for every cycle T of the clock signal CLK.

The data driver 30 and the scan driver 20 may be directly mounted on an organic panel including the image display portion 10.

As described above, exemplary embodiments of the present invention provide a smaller scan driving apparatus using less power, a flat panel display having the same, and a driving method thereof, in which a scan signal is generated with a control signal and output signals of two registers. According to an exemplary embodiment of the present invention, four scan signals may be generated every cycle of the clock signal transmitted to the scan driver. Thus, the frequency of the clock signal decreases, thereby decreasing power consumption due to register switching. Further, fewer registers may be used, thereby decreasing the scan driver's size.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A scan driving apparatus, comprising:

a shift register generating output signals shifted in sequence in response to a clock signal; and a scan signal generator, wherein the scan signal generator generates at least four scan signals in a cycle of the clock signal based on the output signals from the shift register and at least a first control signal and a second control signal.

2. The scan driving apparatus of claim 1, wherein the shift register comprises n/2+1 registers, and wherein n is a positive integer.

3. The scan driving apparatus of claim 2, wherein the scan signal generator comprises n NAND gates, and wherein a NAND gate generates a scan signal based on output signals from the shift register and the first control signal or the second control signal.

4. The scan driving apparatus of claim 3, wherein the first control signal and the second control signal have a same cycle and start at different times.

5. The scan driving apparatus of claim 4, wherein odd NAND gates generate the scan signal based on the first control signal and output signals from an $i^{th}$ register and an $(i+1)^{th}$ register, wherein even NAND gates generate the scan signal based on the second control signal and the output signals from the $i^{th}$ register and the $(i+1)^{th}$ register, and wherein i is a positive integer of 1 or more.

6. The scan driving apparatus of claim 5, wherein output signals of a $1^{st}$ register are transmitted to a $1^{st}$ NAND gate and a $2^{nd}$ NAND gate;

wherein output signals of a $(n/2+1)^{th}$ register are transmitted to a $(n-1)^{th}$ NAND gate and a $n^{th}$ NAND gate; and wherein output signals of a $2^{nd}$ register through a $(n/2)^{th}$ register are transmitted to four NAND gates, respectively.

7. The scan driving apparatus of claim 6, wherein output signals of a $j^{th}$ register among the $2^{nd}$ register through the $(n/2)^{th}$ register are transmitted to a $(k-3)^{th}$ NAND gate, a $(k-2)^{th}$ NAND gate, a $(k-1)^{th}$ NAND gate, and a $k^{th}$ NAND gate, wherein j=2, 3, 4, . . . , n/2, and wherein k=2×j.

8. The scan driving apparatus of claim 7, wherein output signals of two adjacent registers among the $2^{nd}$ register through the $(n/2)^{th}$ register are transmitted to two adjacent NAND gates.

9. A flat panel display, comprising:

an image display part having a plurality of pixels defined by n scan lines and m data lines;

a scan driver outputting at least four scan signals in sequence to the scan lines in a cycle of a clock signal; and a data driver transmitting a data signal to the data lines.

10. The flat panel display of claim 9, further comprising:

a controller;

wherein the controller transmits a start pulse, a first control signal and a second control signal to the scan driver, and wherein the controller transmits a data control signal to drive the data driver.

11. The flat panel display of claim 10, wherein the scan driver comprises:

a shift register shifting the start pulse from the controller in sequence and outputting output signals in response to the clock signal; and a scan signal generator generating a scan signal based on the output signals from the shift register and at least the first control signal and the second control signal.

12. The flat panel display of claim 11, wherein the shift register comprises n/2+1 registers.

13. The flat panel display of claim 12, wherein the scan signal generator comprises n NAND gates, and wherein a NAND gate generates the scan signal based on the output signals from the shift register and the first control signal or the second control signal.

14. The flat panel display of claim 13, wherein the first control signal and the second control signal have a same cycle and start at different times.

15. The flat panel display of claim 14, wherein odd NAND gates generate the scan signal based on the first control signal and output signals from an $i^{th}$ register and an $(i+1)^{th}$ register, wherein even NAND gates generate the scan signal based on the second control signal and the output signals from the $i^{th}$ register and the $(i+1)^{th}$ register, and wherein i is a positive integer of 1 or more.

16. The flat panel display of claim 15, wherein output signals of a $1^{st}$ register are transmitted to a $1^{st}$ NAND gate and a $2^{nd}$ NAND gate;

wherein output signals of a $(n/2+1)^{th}$ register are transmitted to a $(n-1)^{th}$ NAND gate and a $n^{th}$ NAND gate; and wherein output signals of a $2^{nd}$ register through a $(n/2)^{th}$ register are transmitted to four NAND gates, respectively.

17. The flat panel display of claim 16, wherein output signals of a $j^{th}$ register among the $2^{nd}$ register through the $(n/2)^{th}$ register are transmitted to a $(k-3)^{th}$ NAND gate, a $(k-2)^{th}$ NAND gate, a $(k-1)^{th}$ NAND gate, and a $k^{th}$ NAND gate, wherein j=2, 3, 4, . . . , n/2, and wherein k=2×j.

18. The flat panel display of claim 17, wherein output signals of two adjacent registers among the $2^{nd}$ register through the $(n/2)^{th}$ register are transmitted to two adjacent NAND gates.

19. The flat panel display of claim 9, wherein the data driver transmits the data signal corresponding to at least four horizontal lines to a data line in the cycle of the clock signal.

20. A method of driving a flat panel display comprising an image display part having a plurality of pixels defined by n scan lines and m data lines, the method comprising:

transmitting at least four scan signals in sequence to the scan lines in a cycle of a clock signal; and transmitting a data signal synchronized with the scan signals to the data lines.

21. The method of claim 20, wherein transmitting the scan signals in sequence comprises:

allowing n/2+1 registers to shift start pulses in sequence and transmit output signals in response to the clock signal; and using n NAND gates to generate a scan signal based on a first control signal and a second control signal and output signals of the registers.

22. The method of claim 21, wherein the first control signal and the second control signal have a same cycle and start at different times.

23. The method of claim 22, wherein transmitting the data signal comprises transmitting the data signal corresponding to at least four horizontal lines to a data line in the cycle of the clock signal.

* * * * *